US005682817A

United States Patent [19]

Iannuzi et al.

[11] Patent Number: 5,682,817

[45] Date of Patent: Nov. 4, 1997

[54] QUICK REMOVING COMPACT DISC PRINTING NEST

[75] Inventors: Peter Iannuzi, Cherry Hill; Slobodan Casl, Williamstown, both of N.J.

[73] Assignees: Sony Corporation, Tokyo, Japan; Sony Music Entertainment, Inc., New York, N.Y.

[21] Appl. No.: 673,035

[22] Filed: Jul. 1, 1996

[51] Int. Cl.[6] ..... B05C 17/06

[52] U.S. Cl. ..... 101/126; 101/35

[58] Field of Search ..... 101/35, 126, 129, 101/DIG. 36, 127.1

[56] References Cited

U.S. PATENT DOCUMENTS 5,165,340 11/1992 Karlyn et al. ..... 101/126
5,375,517 12/1994 Graener et al. ..... 101/129
5,429,045 7/1995 Karlyn et al. ..... 101/35
5,476,039 12/1995 Hiruta et al. ..... 101/126
5,609,102 3/1997 Rapp ..... 101/35

*Primary Examiner*—Ren Yan
*Attorney, Agent, or Firm*—William S. Frommer; Alvin Sinderbrand

[57] ABSTRACT

A compact disc printing nest for retaining a compact disc along a transportation mechanism which moves the printing nest into a position such that one surface of the compact disc can be screen printed with artwork and/or designs. The compact disc printing nest includes a bottom plate capable of being rigidly secured to the transportation mechanism and a top plate having a receptacle provided in an upper surface thereof for accommodating the compact disc therein and thereby exposing a surface of the compact disc to be screen printed. A magnetic mounting assembly is provided for mounting the top plate with respect to the lower plate to provide for easy removal of the top plate for cleaning and replacement.

21 Claims, 9 Drawing Sheets

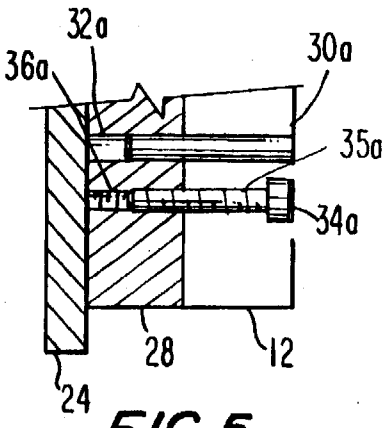
FIG. 5
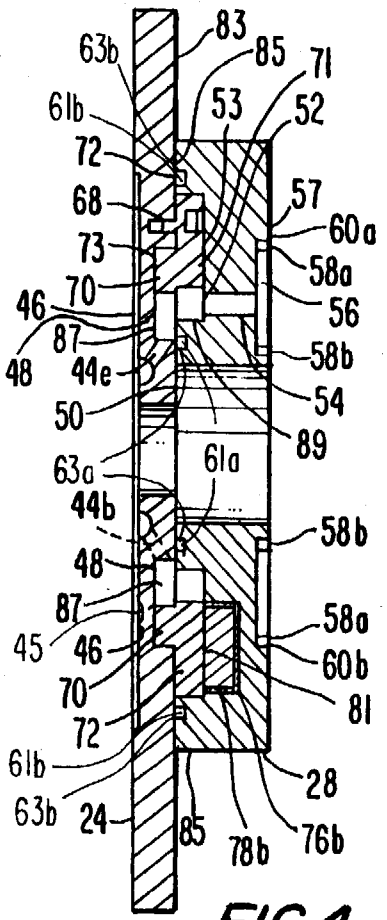
FIG. 4
FIG. 3
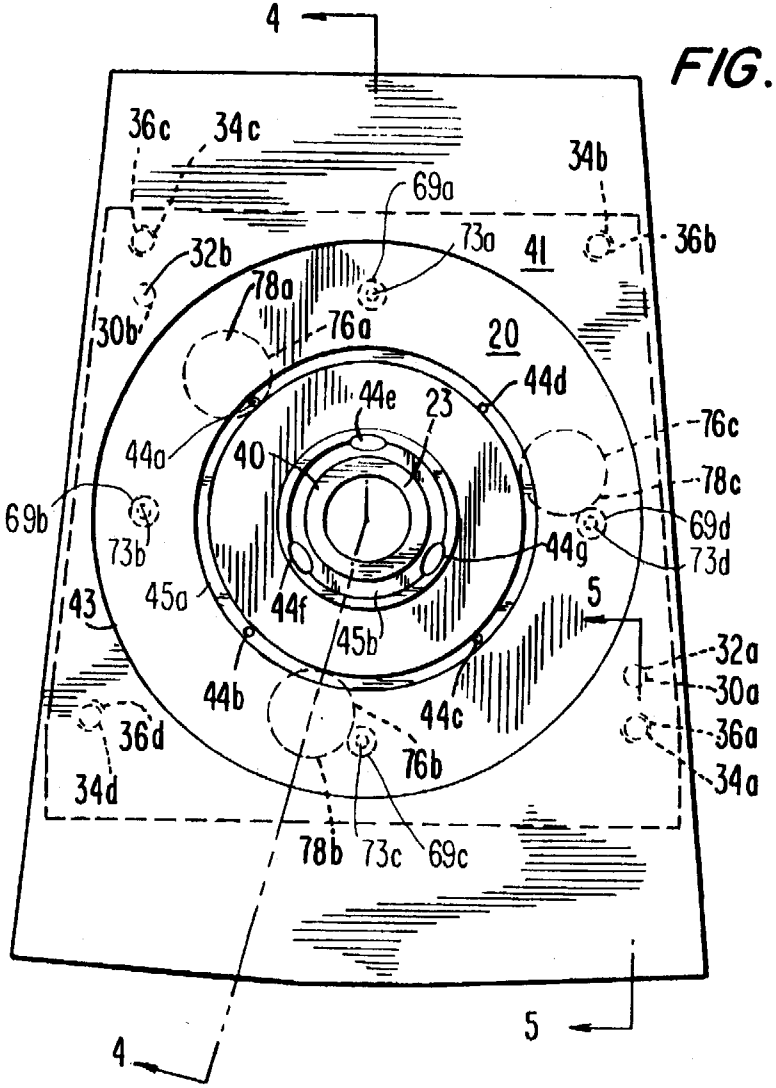

QUICK REMOVING COMPACT DISC PRINTING NEST

FIELD OF THE INVENTION

This invention relates to a printing nest utilized during screen printing of compact discs, and more particularly, to a printer nest used during screen printing of compact discs which is easy to remove and clean such that production and maintenance downtime are reduced.

BACKGROUND OF THE INVENTION

A video or audio recorded compact disc includes a video or audio recorded data surface and another surface providing textual information and/or artwork and designs (hereinafter "the label surface"). This label surface may include aesthetically pleasing artwork and/or designs pertaining to the particular artists, recording companies, etc., of that compact disc. Moreover, the label surface can include printed matter pertaining to the compact disc, such as the title of the compact disc, the title of the individual tracks on the recorded data surface, the duration of each track, etc.

In order to print the label surface of the compact disc with such aesthetically pleasing artwork and/or design, the compact disc is typically retained in a printing nest with the label surface exposed such that the label surface is in a position capable of being screen printed by a screen printing unit. The printing nest is usually mounted on a transportation or conveying mechanism such that the printing nest is moved into a position beneath the screen printing unit. This screen printing unit includes a screen mesh with a stenciled pattern corresponding to the desired artwork or design to be printed onto the label surface of the compact disc. The screen mesh of the screen printing unit is lowered to abut against the label surface of the compact disc. When the mesh screen is in this abuttable position, pigment is dispensed and spread over the screen mesh, which is then pushed through by a squeegee such that the desired artwork or design is printed onto the label surface of the compact disc.

Typically, printing nests are made out of a single plate unit rigidly secured to a transportation mechanism, such as a rotary table. Accordingly, the printing nest has to be cleaned at the printer site and production time thus has to be scheduled for removal, replacement and cleaning of the printing nests. It has therefore been found desirable to provide for a design for a compact disc printing nest which is easily cleaned and easily accessible for removal and replacement so that production and maintenance downtime are reduced.

In prior printing nests formed of the aforementioned top and lower plates, in order to properly position the top plate with respect to the lower plate, alignment pins or positioning pins have been utilized. As a result thereof, additional operator time or equipment is necessary to properly mate the alignment or positioning pins of one plate with the corresponding sockets or receptacle of the other plate. It has therefore also been found desirable to design a compact disc printing nest which alleviates the need to use alignment pins or positioning pins to properly mount the top plate with respect to the lower plate.

OBJECTS OF THE INVENTION

Therefore, it is an object of the present invention to provide a compact disc printing nest which avoids the aforementioned disadvantages of the prior art.

An additional object of the present invention is to provide a compact disc printing nest which provides for quick removal, replacement and cleaning thereof to minimize production and maintenance downtime.

Another object of the present invention is to provide a compact disc printing nest which does not require any alignment pins or positioning pins to properly mount the top plate with respect to the lower plate.

A further object of this invention is to provide a compact disc printing nest which allows the top plate to "float free" with respect to the lower plate.

An additional object of this invention is to provide a compact disc printing nest wherein the top plate is not rigidly secured to the lower plate such that the top plate can be easily removed and replaced and the top and lower plates can be easily cleaned.

Various other objects, advantages and features of the present invention will become readily apparent from the ensuing detailed description and the novel features will be particularly pointed out in the appended claims.

SUMMARY OF THE INVENTION

In accordance with the present invention, a printing nest is provided to be used in conjunction with screen printing of compact discs. The printing nest of the present invention includes a top plate and a lower plate formed of anodized aluminum. The upper surface of the top plate has a receptacle therein for accommodating a compact disc and exposing the label surface of the compact disc which is to be screen printed. The lower plate of the printing nest is rigidly secured to a mechanism for moving the printing nest into a position to be screen printed, such as a rotary table.

The compact disc accommodated within the receptacle is then moved by the transportation mechanism into a position beneath a compact disc screen printing unit which includes a screen mesh with a stenciled pattern corresponding to the desired artwork or design which is to be printed on the label surface of the compact disc. The screen mesh of the screen printing unit is lowered to abut against the label surface of the compact disc. When the screen mesh is in this abuttable position, pigment is dispensed and distributed over the screen mesh which is then pushed through by a squeegee to spread the pigment across the mesh screen such that the desired artwork and/or design is in turn printed on the label surface of the compact disc.

In order to retain the compact disc in the receptacle provided in the upper surface of the top plate of the compact disc printing nest of the present invention, a vacuum communication system is provided in the top and bottom plates which is in registration with a vacuum source. This vacuum communication system includes mating vacuum communication conduits provided in the top and lower plates.

In accordance with one of the general objects of the present invention, the construction of the compact disc printing nest of the present invention allows for easy access for removal and replacement of the top plate as well as cleaning of both the top and lower plates so as to minimize maintenance and production downtime. In accordance therewith, the top plate and the lower plate are provided with a magnetic mounting assembly for mounting the top plate with respect to the lower plate. This magnetic mounting assembly includes a plurality of cylindrical magnets embedded in corresponding magnet cavities provided in an annular depression of the upper surface of the lower plate and a generally annular magnetic ring rigidly secured to the top plate. As a result of this design, the top plate is mounted with respect to the lower plate when the annular magnetic ring is magnetically engaged with the cylindrical magnets.

Accordingly, since the top plate can be easily removed with respect to the lower plate when the magnetic attraction between the annular magnetic ring and the cylindrical magnets is overcome, the maintenance time required to replace the top plate and/or clean the top and lower plates is reduced. In addition, this magnetic mounting assembly allows the top plate to "float free" with respect to the lower plate, which, in turn, results in absorption of some of the printing stroke forces.

The printing nest of the present invention also alleviates the requirement that the top plate be mounted with respect to the lower plate by alignment or positioning pins. In order to achieve this result, the generally annular magnetic ring includes an inward upwardly extending side edge fitted into an annular opening provided in a bottom surface of said top plate and an outwardly extending flange member which when the magnetic ring is fitted into the annular depression provided in the upper surface of the lower plate, the annular magnetic ring is magnetically engaged with the cylindrical magnets.

BRIEF DESCRIPTION OF THE DRAWINGS

The following detailed description, given by way of example, will best be understood in conjunction with the accompanying drawings in which:

FIG. 3 is a top elevational view of the compact disc printing nest of FIG. 2.

FIG. 4 is a side cross-sectional view taken along line 4—4 of FIG. 3.

FIG. 5 is a side cross-sectional view taken along line 5—5 of FIG. 3.

DETAILED DESCRIPTION OF A PREFERRED EMBODIMENT

Figure 1:
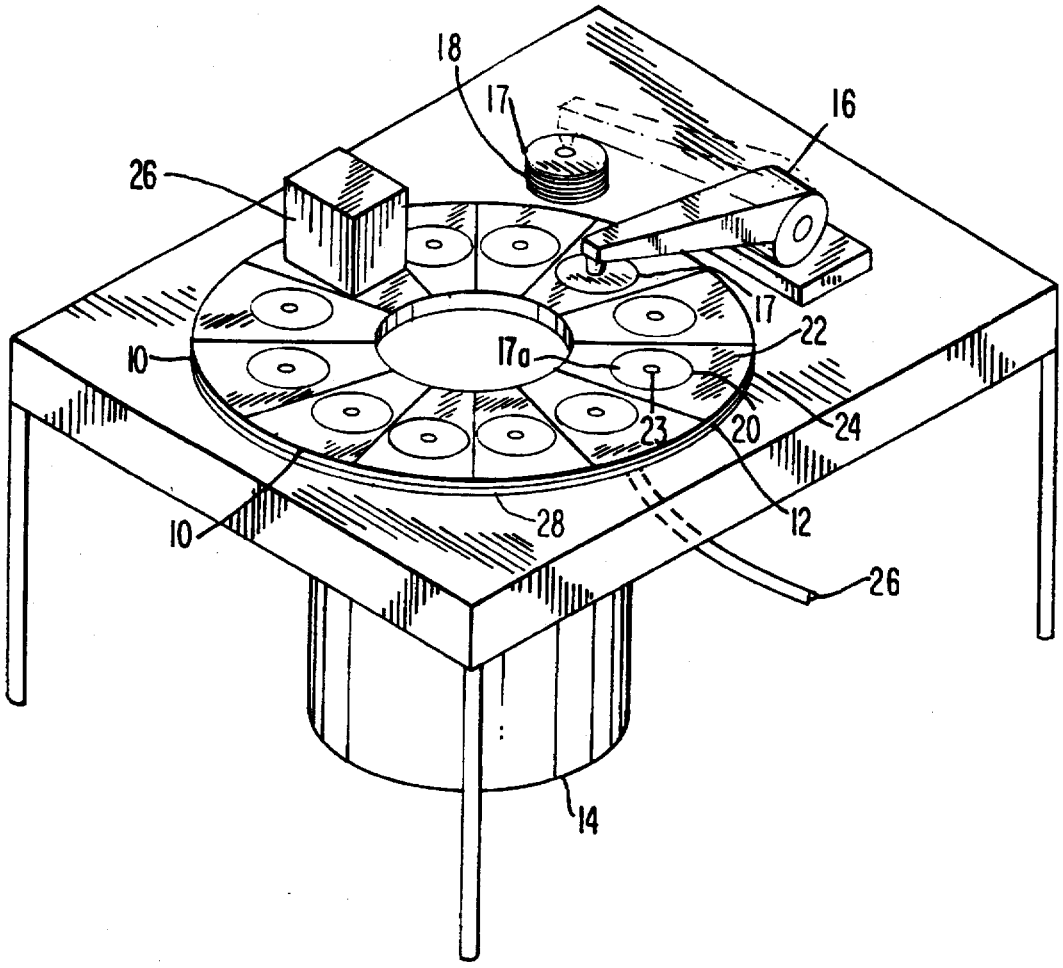
FIG. 1 is a front perspective view of a plurality of compact disc printing nests in accordance with the teachings of the present invention being supported on a rotary table for movement to various workstations.

Referring now to the drawings, wherein like reference numerals are used throughout, there is illustrated a preferred embodiment of a compact disc printing nest in accordance with the present invention. As will be explained in detail below, this compact disc printing nest is used in conjunction with a screen printing unit which prints artwork and/or designs on the label surface of a compact disc.

As is shown in FIG. 1, a plurality of printing nests 10 in accordance with the present invention are mounted on a transportation mechanism, such as rotary table 12. This rotary table 12 is rotatable by means of a rotary motor, such as is generally designated by reference numeral 14, to various selected workstations.

More specifically, in this screen printing assembly, a pick-up mechanism, such as robotic grasping arm 16, removes a leading compact disc 17 from a stack of compact discs 18 and moves the compact disc into a position above the rotary table 12. Upon a predetermined rotation of the rotary table 12, a receptacle 20 provided in the upper surface 22 of the top plate 24 of the compact disc printing nest 10 is moved into a predetermined position to receive the compact disc 17 from the pick-up mechanism 16. The compact disc 17 is then lowered by the pick-up mechanism and fitted into the receptacle 20 with the central hub 21 of the compact disc 17 aligned with the receiving hub 23 of the receptacle 20 (see FIG. 3). In this retained position, the label surface **17*a* of the compact disc is exposed. As will be discussed in further detail below, the compact disc 17 is reliably retained in the receptacle 20 by means of a vacuum communication system provided in the printing nest 10 which is in registration with a vacuum source, generally designated as 26**.

The printing nest 10 retaining compact disc 17 is then moved by the rotary table 12 to a position immediately below a screen printing unit 26. As will be readily understood by those of ordinary skill in the art, this screen printing unit 26 includes a screen mesh (not shown) provided with a desired stenciled pattern of the corresponding artwork and/or design which is to be printed onto the label surface **17*a* of the compact disc 17. When the printing nest 10 is properly positioned beneath the screen printing unit 26, the screen mesh is lowered to abut against the label surface 17*a* of the compact disc 17 retained in the receptacle 20. A pigment is then dispersed and spread onto the screen mesh and is then pushed through by a squeegee (not shown) such that the desired artwork and/or design is printed onto the label surface 17*a* of the compact disc 17**.

Figure 2:
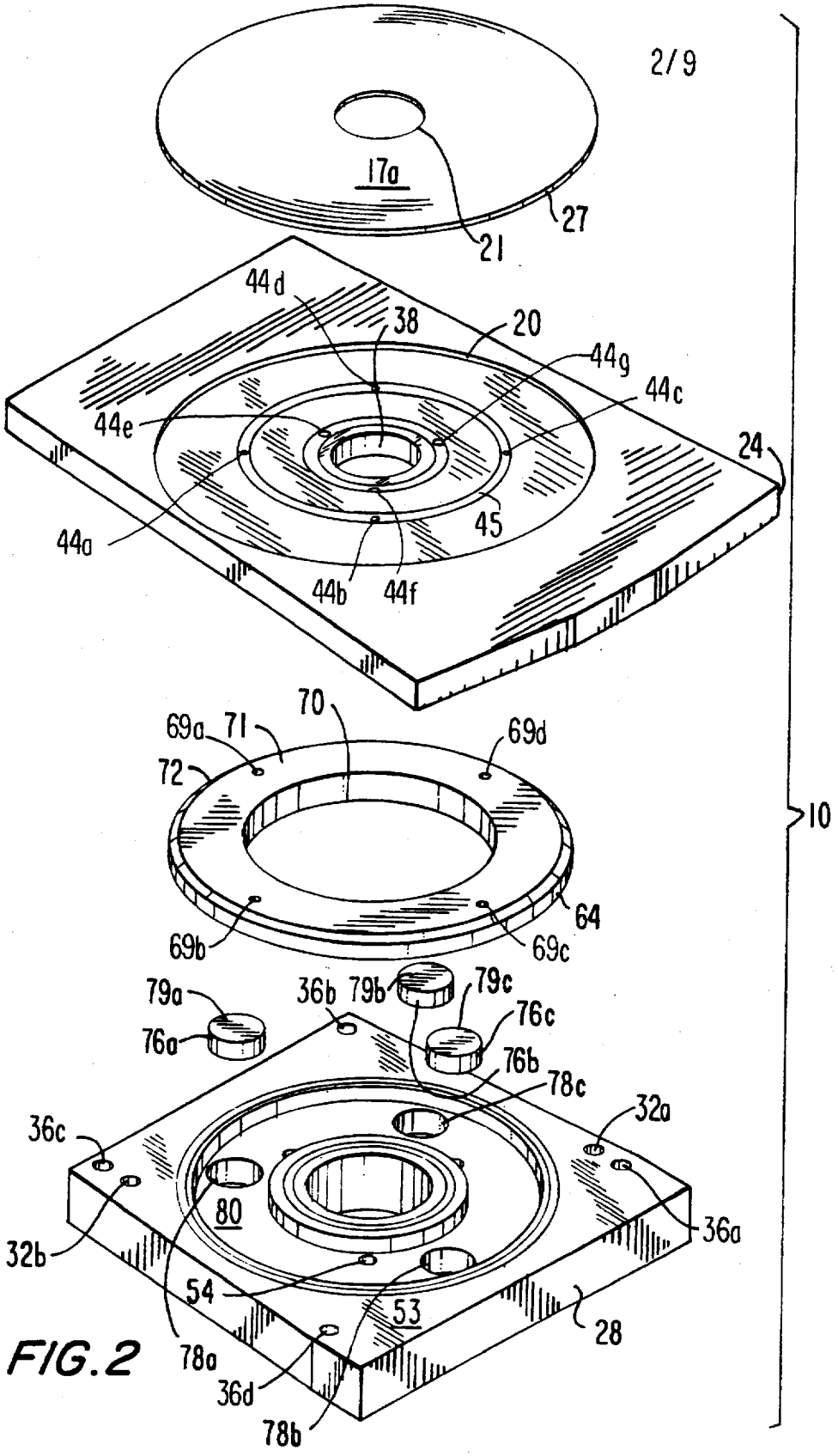
FIG. 2 is an exploded perspective view of a preferred embodiment of a compact disc printing nest in accordance with the teachings of the present invention.

The compact disc printing nest 10 of the present invention will now be described. As is best shown in FIGS. 2 through 4, the printing nest 10 of the present invention is in generally the form of an arc-shaped segment and includes two plates: namely; the aforedescribed top plate 24 and a lower plate 28. The top and lower plates 24 and 28 are made out of aluminum and anodized after being machined to the required dimension. The anodizing process includes a lubricant coating (i.e., Teflon) which is applied to both the top and lower plates 24 and 28.

Figure 11:
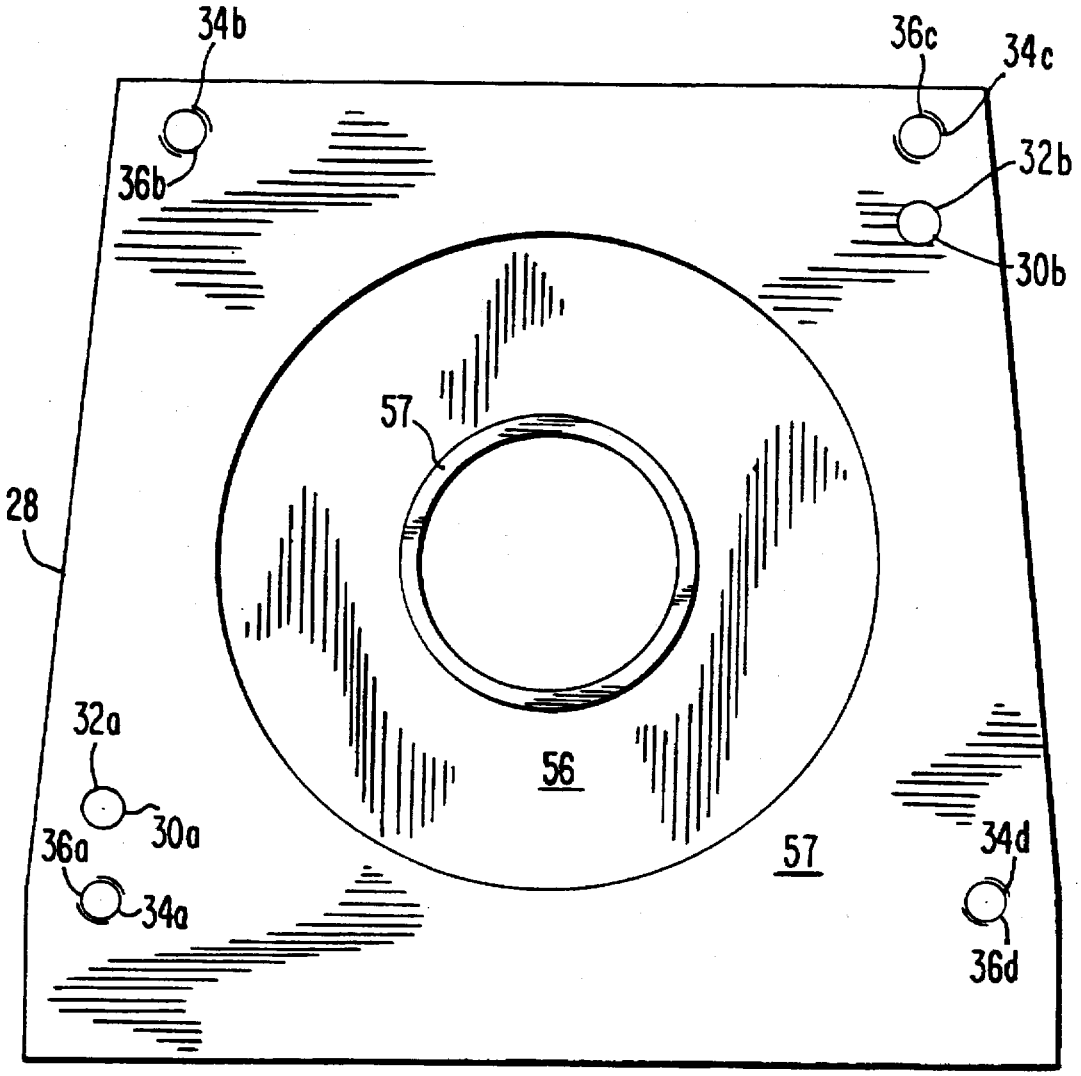
FIG. 11 is a bottom elevational view of the lower plate of the compact disc printing nest of FIGS. 2 and 3.
Figure 13:
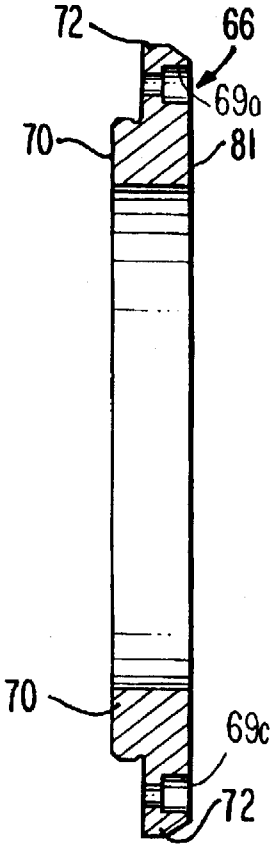
FIG. 13 is a side cross-sectional view of the generally annular magnetic ring of FIG. 12.
Figure 14:
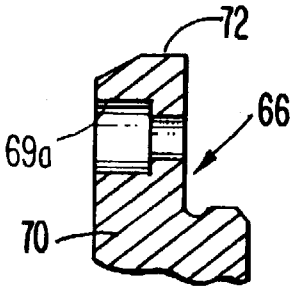
FIG. 14 is an enlarged side cross-sectional view of an end portion of the generally annular magnetic ring of FIGS. 12 and 13.
Figure 12:
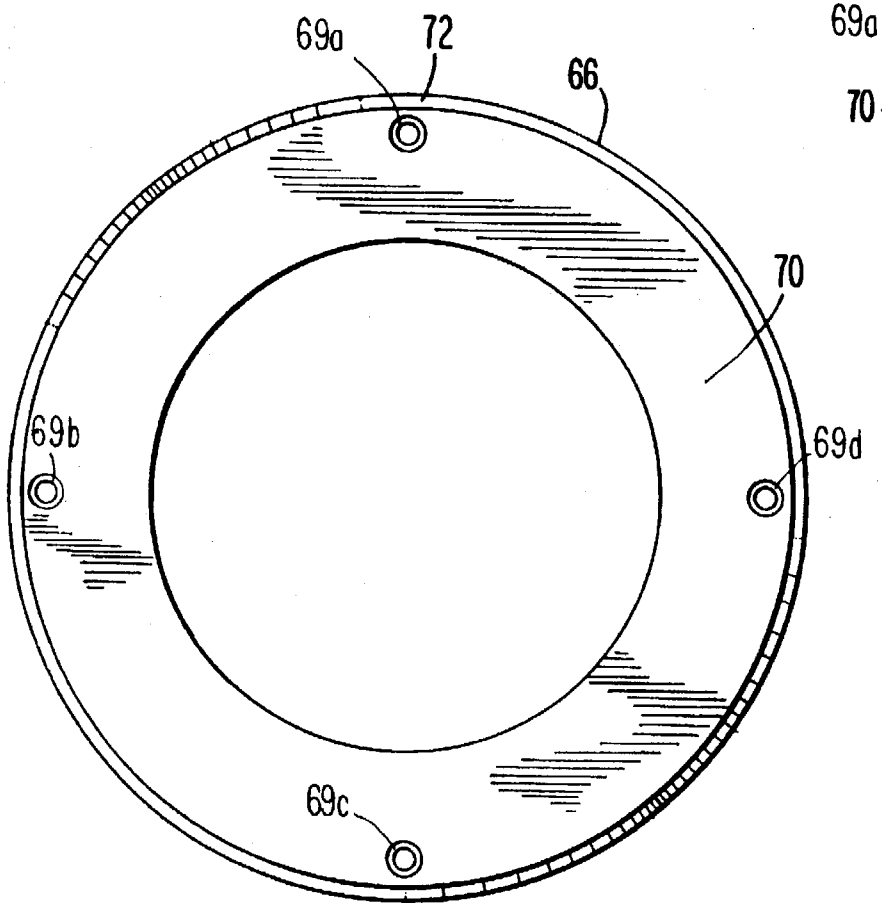
FIG. 12 is a bottom elevational view of the generally annular magnetic ring of the compact disc printing nest of FIGS. 2 and 3.

As is best shown in FIGS. 3 and 5, the lower plate 28 is rigidly secured to the transportation mechanism 12. In the preferred embodiment, the lower plate is secured to the transportation mechanism 12 by means of two dowel or register pins **30*a* and 30*b* extending upwardly from the top surface of the transportation mechanism 12 which extend through guide grooves 32*a* and 32*b* extending through the lower plate 28. As is best shown in FIGS. 3 and 11, these guide grooves 32*a* and 32*b* are provided at two opposite corners of the lower plate 28**.

In addition, in furthering rigid securement of the lower plate 28 to the transportation mechanism 12, M6 sized metric screws 34a, 34b, 34c and 34d extend through guide grooves 35a, 35b, 35c, and 35d passing through the transportation mechanism 12 and corresponding guide grooves 36a, 36b, 36c, and 36d passing through the lower plate 28. These guide grooves 36a, 36b, 36c and 36d are provided at generally the four corners of the lower plate 28 (see FIGS. 3 and 11). As will be discussed in further detail below, the top plate 24 is properly mounted relative to the lower plate 28 by means of a magnetic mounting assembly provided in the top and lower plates 24 and 28.

As aforedescribed, in order to properly align the compact disc 17 in the receptacle 20 formed in the upper surface 41 of the top plate 24 of the printing nest 10, a receiving hub 23 having an upstanding annular side surface 40 is provided in the receptacle 20. As a result thereof, the central hub or opening 21 of the compact disc 17 can be properly aligned over the upstanding side surface 40 of the receiving hub 23 while the outer periphery 27 of the compact disc is constrained within the outer peripheral edge surface 43 of the receptacle 20.

Figure 7:
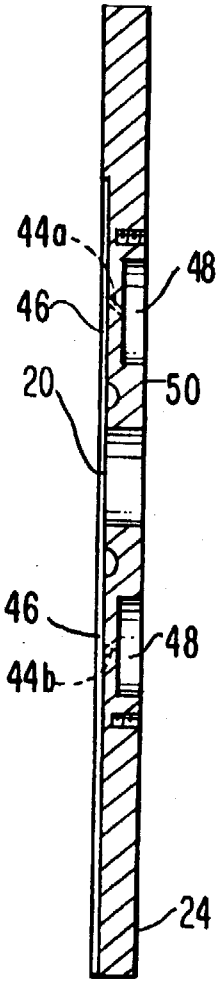
FIG. 7 is a side cross-sectional view taken along line 7—7 of FIG. 6.
Figure 6:
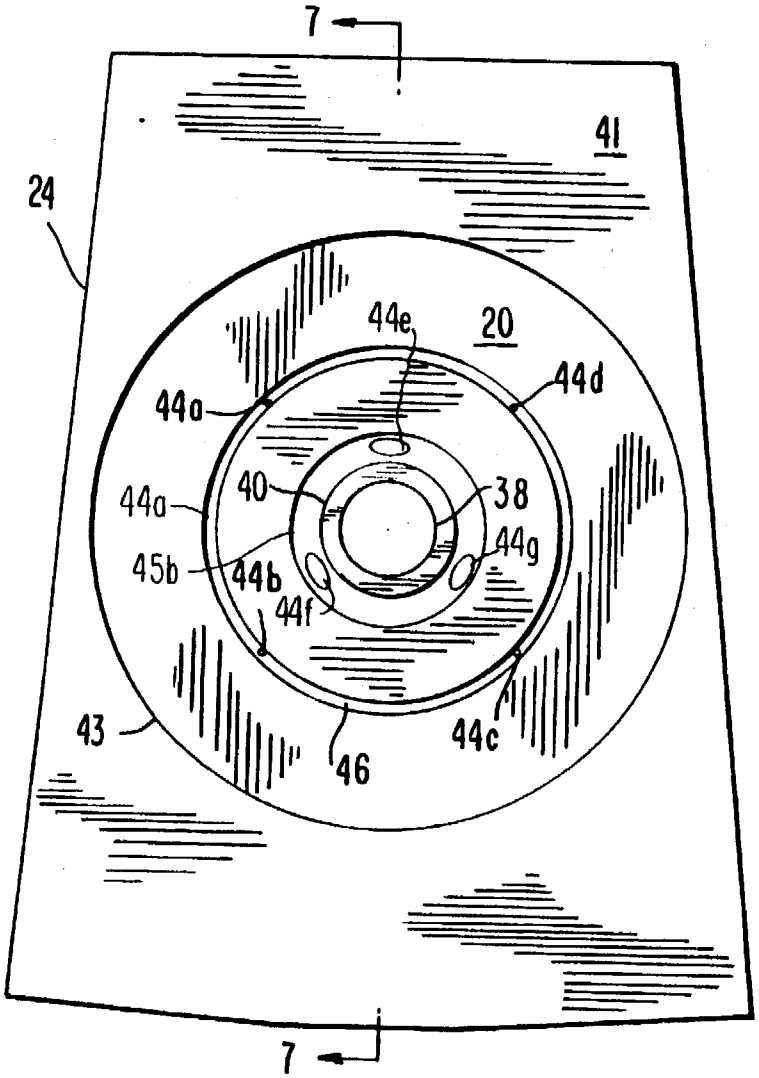
FIG. 6 is a top elevational view of the top plate of the compact disc printing nest of FIGS. 2 and 3.

In order to prevent movement of the compact disc within the receptacle 20 and thereby provide for accurate screen printing of the compact disc, a vacuum communication system is provided within the upper and lower plates 24 and 28 of the printing nest 10 of the present invention. In this vacuum communication system, a plurality of a first set of vacuum ports, such as 44a, 44b, 44c and 44d (see FIGS. 3 and 6), are machined into an outer annular depression 45a formed in the top surface 41 of the top plate 24 and angularly extend through the top plate 24 so as to be in registration with an open section 87 of an annular groove 48 formed in the bottom surface 50 of the top plate 24. Moreover, a plurality of a second set of angular displaced generally oval vacuum parts 44c, 44f and 44g machined into an inner annular depression 45b found in the surface 41 of the top plate 24. (Therefore, as best shown in FIG. 4, the vacuum ports 44e, 44f, and 44g are in communication with corresponding generally conical vacuum passageways, such as 46, bored into the top plate 24 (see FIGS. 4 and 7), which are, in turn, in registration with the open section 87 of the annular groove 48 formed in the bottom surface 50 of the top plate 24.

When the top plate 24 is properly mounted with respect to the lower plate 28, the open section 87 of the annular groove 48 mates with an exposed section 89 of an annular depression 52 provided in the top surface 53 of the lower plate 28 (see FIG. 4), which is in turn in communication with a central vacuum passageway 54 extending through the lower plate 28. This central vacuum passageway 54 opens into an annular groove 56 provided in the bottom surface 57 of the lower plate 28 (see FIGS. 4 and 11). This annular groove 56 is in registration with suitable tubing or the like 26 which is connected to the vacuum source (see FIG. 1).

Thus, when a vacuum is generated, the compact disc 17 is reliably retained within the receptacle 20 by means of the vacuum communication path formed of the first and second sets of vacuum ports 44a, 44b, 44c, 44d, 44e, 44f, and 44g, the conical vacuum passageway 46, the open section 87 of the annular groove 48, the exposed section 89 of the annular depression 52, the central vacuum passageway 54 and the annular groove 56 of the lower plate 28.

As is shown in FIG. 4, in order to assist in properly securing the vacuum seal between the rotary table 12 and the lower plate 28, O-rings 58a and 58b are provided respectively at the outer and inner peripheries 60a and 60b of the annular groove 56.

In addition, as is shown in FIG. 4, O-rings 61a and 61b are provided respectively in inner and outer annular grooves 63a and 63b provided in the top surface 53 of the lower plate 28. These O-rings 61a and 61b provide for a vacuum seal for the vacuum communication path, and alternatively, such O-ring seals 61a and 61b may restrict contaminants from entering this section of the printing nest.

In accordance with one of the general objects of the present invention, the compact disc printing nest 10 of the present invention allows for easy access for removal and replacement of the top plate 24 as well as for easy cleaning of both the top and lower plates 24 and 28 so as to minimize maintenance and production downtime. In order to achieve this result, a magnetic mounting assembly is provided in the compact disc printing nest 10 of the present invention to mount the top plate 24 with respect to the lower plate 28.

Figure 8:
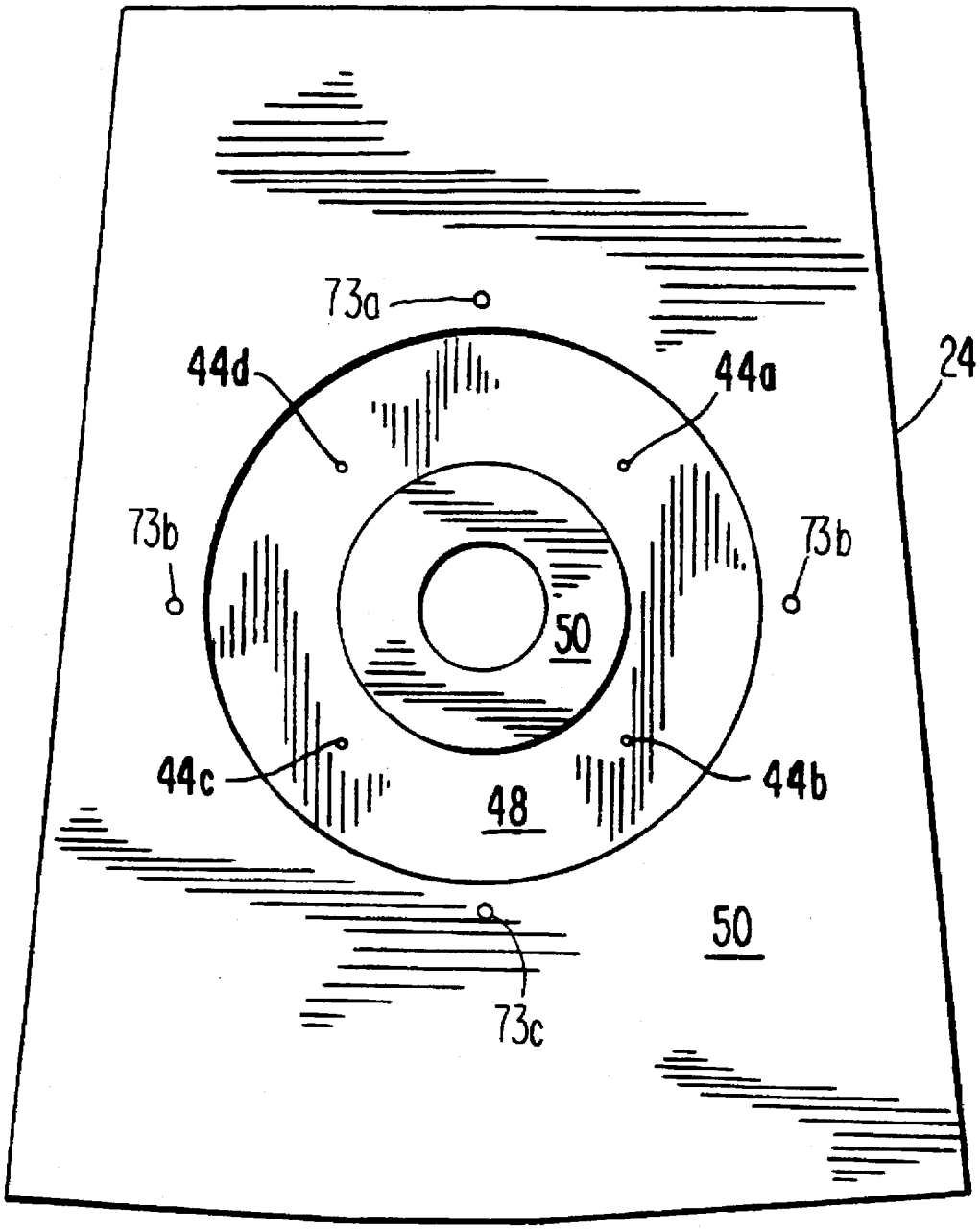
FIG. 8 is a bottom elevational view of the top plate of the compact disc printing nest of FIGS. 2 and 3.
Figure 10:
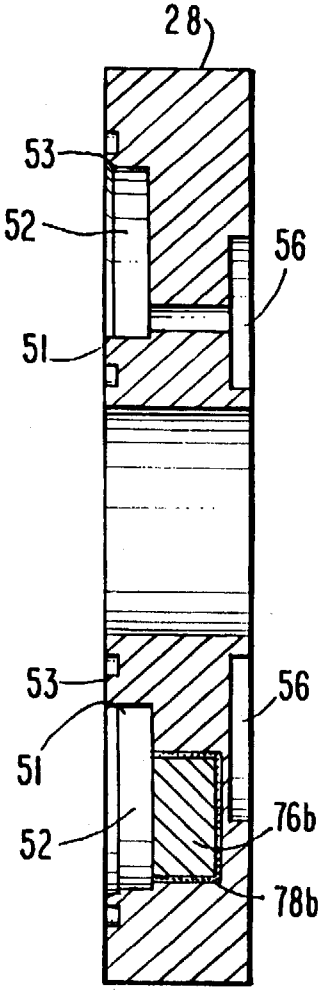
FIG. 10 is a side cross-sectional view taken along line 10—10 of FIG. 9.

As is best shown in FIGS. 2 through 4 and 12 through 14, this magnetic mounting assembly includes a generally annular magnetic ring 64 formed of magnetic stainless steel which is mounted to the bottom surface 50 of the top plate 24 by means of fastening members, such as 68a, *b*, *c*, and *d* (see FIG. 15), which extend through fastening bores 69a, *b*, *c* and *d* formed in the magnetic ring 64 and corresponding fastening bores 73a, *b*, *c*, and *d* formed in the bottom surface 50 of the top plate (see FIG. 8). This generally annular magnetic ring 64 includes an inner upstanding extending side edge 70 and a flange portion 72 extending outwardly from the upstanding extending side edge 70 at the lowermost portion 71 thereof. As will be described in more detail below, when the magnetic ring 64 is properly mounted to the bottom surface 50 of the top plate 24, the inward upstanding extending side edge 70 of the magnetic ring 64 is seated within an outer peripheral portion 73 of the annular groove 46 formed in the bottom surface 50 of the top plate 24.

Figure 9:
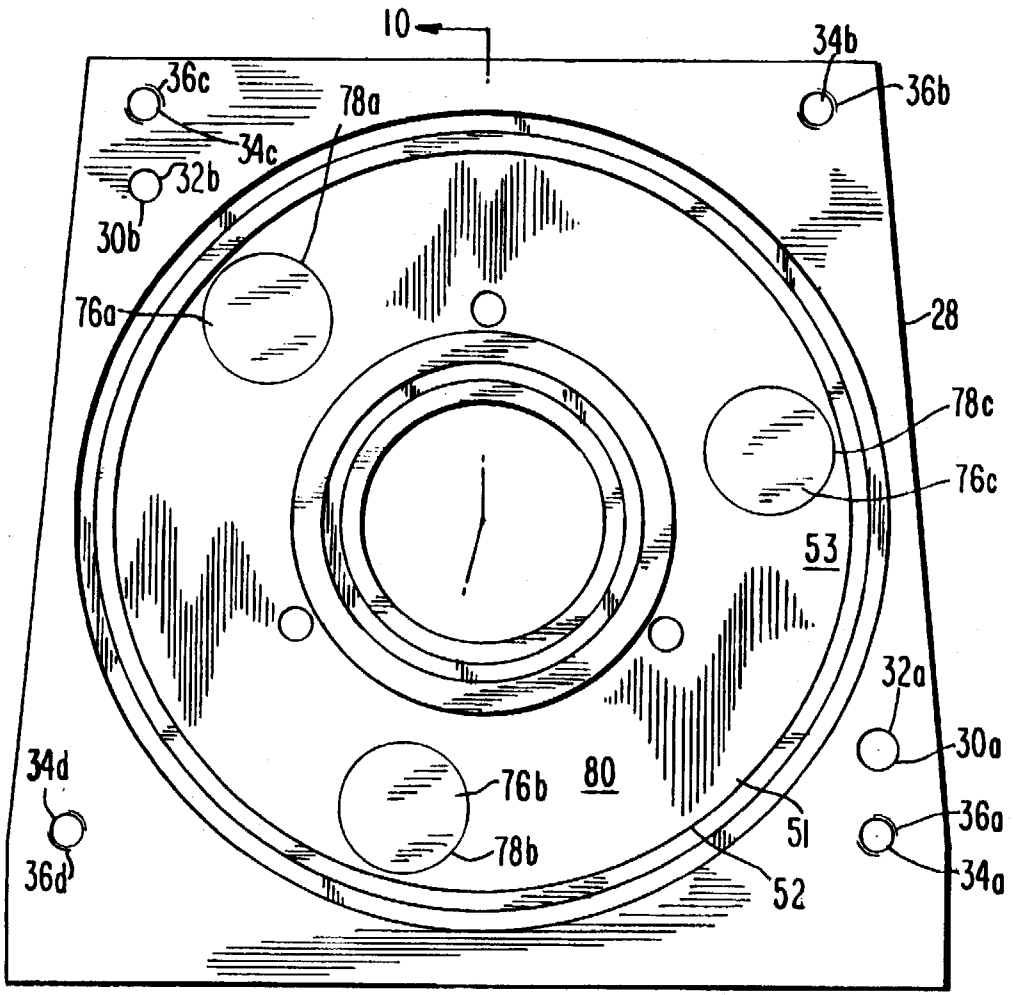
FIG. 9 is a top elevational view of the lower plate of the compact disc printing nest of FIGS. 2 and 3.

The magnetic mounting assembly of the compact disc printing nest 10 of the present invention also include a plurality of cylindrical magnets, such as 76a, 76b, and 76c, which are embedded in magnet retention cavities 78a, 78b and 78c formed in the bottom surface 80 of the annular depression 52 provided in the top surface 53 of the lower plate 28 (see FIGS. 3 and 9). The cylindrical magnets 76a, 76b and 76c are adhesively bonded into the magnet cavities 78a, 78b and 78c such that the top surfaces 79a, 79b and 79c of the magnets are flush with the bottom surface 80 of the annular depression 52. The cylindrical magnets 76a, 76b and 76c are formed of a rare earth magnetic material or similar magnetic material with at least approximately 70 pound/inch pull.

As a result of the design of the magnetic mounting assembly, when the bottom surface 81 of the annular magnetic ring 64 is fitted in the annular depression 52 provided in the top surface 53 of the bottom plate 28 and is flush with the bottom surface 80 thereof, the magnetic ring 64 is magnetically engaged with the cylindrical magnets 76a, 76b and 76c embedded in the corresponding magnet cavities 78a, 78b and 78c.

Accordingly, the top plate 24 can be easily removed with respect to the lower plate 28 when the magnetic attraction between the annular ring 64 and cylindrical magnets 66a, 66b and 66c is overcome to provide for easy access for removal and replacement of the top plate 24 as well as for easy cleaning of both the top and lower plates 24 and 28 of the compact disc printing nest 10 so that production and maintenance downtime are reduced. Moreover, the magnetic mounting assembly of the compact disc printing nest 10 of the present invention absorbs some of the printing stroke forces as the top plate 24 is allowed to "float free" with respect to the lower plate 28.

More specifically, the magnetic ring 64 has approximately a 0.002' clearance with respect to the annular depression 80. This clearance is necessary so that the top plate 24 can be disassembled quickly from the bottom plate 20 with use of average arm strength (no tools required). After the top plate has been properly positioned, it can rotate within certain limits due to the spacing between the printing nests and associated transportation mechanism segments (approx. 1/16") on the rotary table. Printing stroke (squeegee makes contact with the screen and printing nest in the screen printing unit) is the only substantial force applied on the printing nest and it is one dimensional. Therefore, a newly installed top plate can move/rotate but only during the first printing stroke and in the direction of a printing stroke. Thereafter, the top plate will stay registered in place until physically removed. However, this does not affect print registration.

Moreover, magnetic assembly provides a continuous pull force to maintain the lower plate 28 in unison (i.e., properly aligned) with the top plate 24. The top plate bottom surface 50 is resting on the lower plate top surface 63 and these two surfaces absorb printing stroke perpendicular forces. Magnetic assembly and the aforementioned surfaces of the top and lower plates do not limit slide action between the two plates caused by horizontal printing forces. Slide action (also referred above as "move/rotate") is initially limited and then stopped with the side walls 51 of the annular depression 52.

Additionally, for those reasons set forth below, alignment or positioning pins are not necessary to mount the top plate 24 with respect to the lower plate 28 as a result of the design of the compact disc printing nest 10 of the present invention. In accordance therewith, in order for the operator monitoring the screen printing assembly to properly mount the top plate with the bottom plate, the top plate assembly, including the top plate 24 and the generally annular magnetic ring 64, need merely be inserted in the annular depression 52 provided in the top surface 53 of the lower plate 28 such that the bottom surface 81 of the annular magnetic ring 64 bears against the lower surface 80 of the annular depression 52 and the extending bottom edge 83 of the bottom surface 50 of the top plate 24 bears against the outer peripheral surface 85 of the top surface 63 of the bottom plate 24 (see FIGS. 2 and 4). This positioning will force the annular magnetic ring 64 to be magnetically attracted to the cylindrical magnets 66*a*, 66*b*, and 66*c* to thereby properly mount and align the top plate 24 with respect to the lower plate 28.

Figure 15:
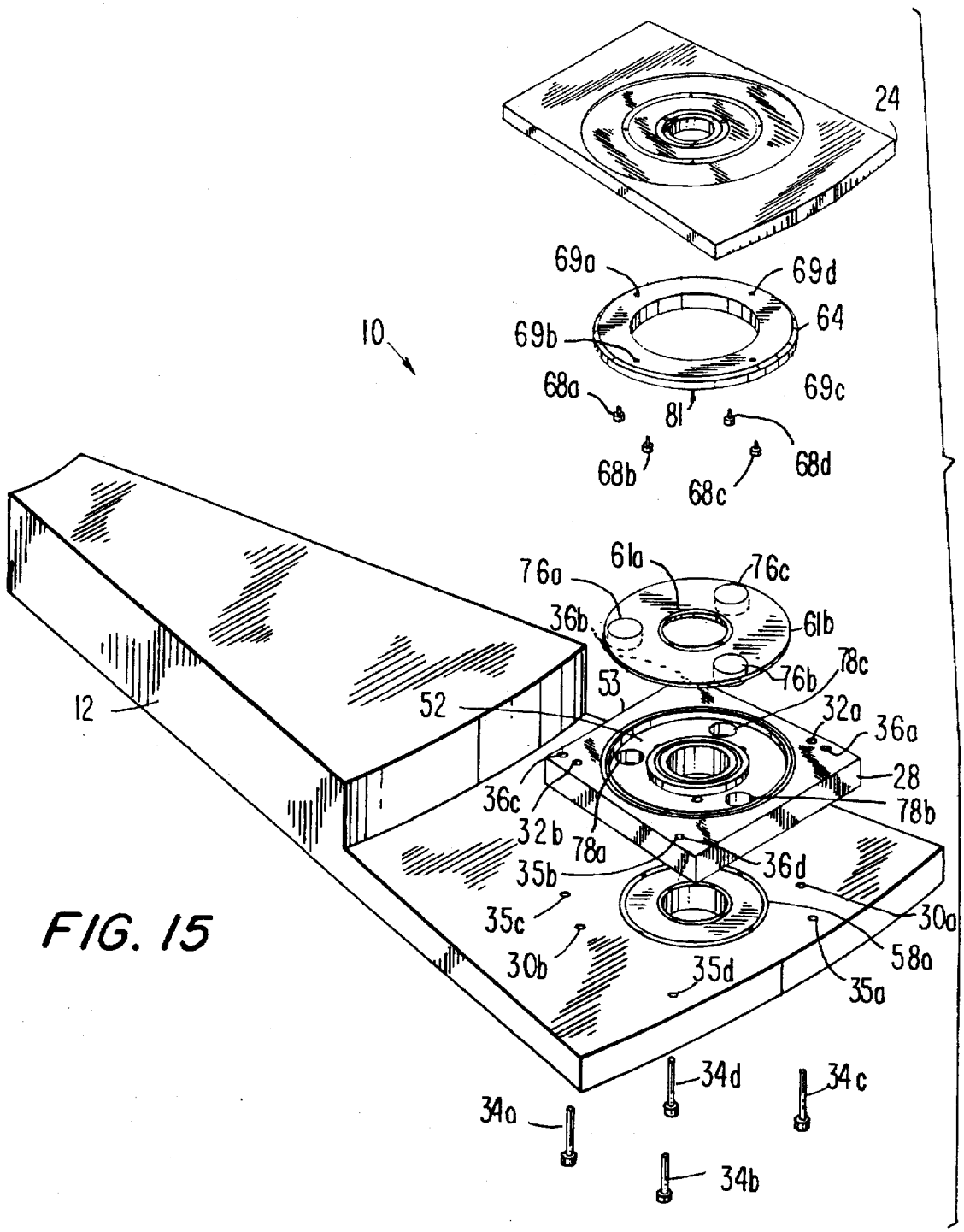
FIG. 15 is an exploded perspective view specifically illustrating the assembly of the printing nest of the present invention on to a transportation mechanism of a rotary table and assembly of the individual components of the printing nest with respect to each other.

FIG. 15 illustrates the assembly of the of the printing nest 10 onto the transportation mechanism 12 and the assembly of the individual components of the printing nest 10. More specifically, prior to retaining the lower plate 28 on the transportation mechanism 12, the O-rings 58*a* and 58*b* are inserted at the outer and inner peripheries 60*a* and 60*b* of the annular groove 56 provided in the bottom surface 57 of the lower plate 28 (not shown in FIG. 15, but shown in FIG. 4). As set forth above, these O-rings 58*a* and 58*b* assist in properly securing the vacuum seal between the rotary table 12 and the lower plate 28. Moreover, O-rings 61*a* and 61*b* are inserted in the inner and outer annular grooves 63*a* and 63*b* provided in the top surface 53 of the lower plate 28 (not shown in FIG. 15, but shown in FIG. 4). In addition, the cylindrical magnets 76*a*, 76*b* and 76*c* are adhesively bonded into the magnetic retention cavities 78*a*, 78*b* and 78*c* formed in the bottom surface 80 of the annular depression 52 provided in the top surface 53 of the lower plate 28.

The lower plate 28 is then fitted onto the transportation mechanism 12 as a result of the registration pins 30*a*, 30*b* extending upwardly from the transportation mechanism 12 being fitted into the guide grooves 32*a* and 32*b* extending through opposite corners of the lower plate 28. In order to further secure the lower plate 28 with respect to the transportation mechanism 12, the M6 sized metric grooves 34*a*, 34*b*, 34*c* and 34*d* are extended through the corresponding guide grooves 35*a*, 35*b*, 35*c* and 35*d* passing through the transportation mechanism 12 and corresponding guide grooves 36*a*, 36*b*, 36*c*, and 36*d* passing through the lower plate.

The magnetic ring 64 is secured to the bottom surface of top plate 24 by means of the fastening members 68*a, b, c*, and *d* extending through fastening bores 69*a, b, c*, and *d* formed in the magnetic ring 64 and corresponding fastening bores 73*a, b, c*, and *d* formed in the bottom surface 50 of the top plate 24 (see FIG. 8). Thus, when the bottom surface 81 of the annular magnetic ring 64 is fitted in the annular depression 52 provided in the top surface 53 of the bottom plate 28 and is flush with the bottom surface 80 thereof, the magnetic ring 64 is magnetically engaged with the cylindrical magnets 76*a*, 76*b* and 76*c* embedded in the magnetic retention cavities 78*a*, 78*b* and 78*c*. Accordingly, the top plate 24 is magnetically mounted for easy removal and cleaning with respect to the lower plate 28.

Based upon the foregoing, it will be appreciated that a compact disc printing nest has been designed which provides for the quick removal of the top plate of the printing nest from the lower plate such that the top plate can be easily removed and replaced and the top and bottom plates can be easily cleaned to minimize production and maintenance downtime. In addition, this compact disc printing nest does not require alignment or positioning pins to mount the top plate with respect to the lower plate. Further, an advantageous feature of this printing nest is that as a result of the magnetic mounting assembly discussed above, the top plate 24 is allowed to "float free" with respect to the lower plate 26 such that some of the printing stroke forces of the screen printing unit are absorbed.

While the present invention has been particularly shown and described with reference to a preferred embodiment, it will be readily apparent to those of ordinary skill in the art that various changes and modifications may be made therein without departing from the spirit and scope of the invention. For example, the printing nest of the present invention cannot only be used in conjunction with a compact disc screen printing assembly but it can also be used as a quick removing jig on a drilling press for a coordinate drilling. It is intended that the appended claims be interpreted as including the foregoing as well as various other such changes and modifications.

What is claimed is:

1. A compact disc printing nest for retaining a compact disc along a transportation means which moves the printing nest into a position such that one surface of the compact disc can be screen printed, said compact disc printing nest comprising:

a bottom plate capable of being rigidly secured to the transportation means;

a top plate having a receptacle for accommodating the compact disc to be screen printed; and magnetic mounting means for mounting said top plate with respect to said lower plate to provide for easy removal of said top plate for cleaning and replacement wherein said magnetic mounting means further comprises:

a plurality of cylindrical magnets embedded in corresponding magnet cavities provided in said lower plate; and a generally annular magnetic ring rigidly secured to said top plate such that said top plate is mounted with respect to said lower plate when said annular magnetic ring is magnetically engaged with said cylindrical magnets.

2. The compact disc printing nest of claim 1 wherein said bottom and top plates are formed of anodized aluminum.

3. The compact disc printing nest of claim 1 wherein said cylindrical magnets are formed of a rare earth metal.

4. The compact disc printing nest of claim 1 wherein said generally annular magnetic ring is formed of stainless steel.

5. The compact disc printing nest of claim 1 wherein said generally annular magnetic ring includes an inward upwardly extending side edge fastened into an annular opening provided in a bottom surface of said top plate and an outwardly extending flange member which when said magnetic ring is fitted into a mounting opening provided in an upper surface of said bottom plate, said annular magnetic ring is magnetically engaged with said cylindrical magnets.

6. The compact disc printing nest of claim 1 wherein said receptacle accommodating said compact disc is provided in an upper surface of said top plate so as to expose a surface of the compact disc to be screen printed and vacuum communication means are provided in said upper and lower plates for reliably retaining the compact disc in said receptacle.

7. The compact disc printing nest of claim 6 wherein said vacuum communication means further comprises mating vacuum communication conduits provided in both said top and lower plates which are in registration with a vacuum source.

8. A compact disc printing nest for retaining a compact disc along a transportation means which moves the printing nest into a position such that one surface of the compact disc can be screen printed, said compact disc printing nest comprising:

a bottom plate capable of being rigidly secured to the transportation means;

a top plate having a receptacle provided in an upper surface thereof for accommodating the compact disc therein and exposing a surface of the compact disc to be screen printed;

magnetic mounting means for mounting said top plate with respect to said lower plate to provide for easy removal of said top plate for cleaning and replacement, said magnetic mounting means including a plurality of cylindrical magnets embedded in corresponding magnet cavities provided in said lower plate, and a generally annular magnetic ring rigidly secured to said top plate such that said top plate is mounted with respect to said lower plate when said magnetic ring is magnetically engaged with said cylindrical magnets; and vacuum communication means provided in said upper and lower plates for reliably retaining the compact disc in said receptacle.

9. The compact disc printing nest of claim 8 wherein said bottom and top plates are formed of anodized aluminum.

10. The compact disc printing nest of claim 8 wherein said cylindrical magnets are formed of a rare earth metal.

11. The compact disc printing nest of claim 8 wherein said generally annular magnetic ring is formed of stainless steel.

12. The compact disc printing nest of claim 8 wherein said generally annular magnetic ring includes an inward upwardly extending side edge fastened into an annular opening provided in a bottom surface of said top plate and an outwardly extending flange member which when said magnetic ring is fitted into a mounting opening provided in an upper surface of said bottom plate, said annular magnetic ring is magnetically engaged with said cylindrical magnets.

13. The compact disc printing nest of claim 8 wherein said vacuum communication means further comprises mating vacuum communication conduits provided in both said upper and lower plates which are in registration with a vacuum source.

14. A compact disc screen printing assembly for printing artwork or designs on a surface of a compact disc, said compact disc printing assembly comprising:

a pick-up mechanism for removing a leading compact disc from a stack of compact discs;

a printing nest having a bottom plate which is rigidly secured to transportation means for moving the printing nest, and a top plate having a receptacle provided in an upper surface thereof for accommodating the leading compact disc received from said pick-up mechanism and exposing a surface of the compact disc, said printing nest including magnetic mounting means for mounting said top plate with respect to said lower plate to provide for easy removal of said top plate for cleaning and replacement, wherein said magnetic mounting means further comprises;

a plurality of cylindrical magnets embedded in corresponding magnet cavities provided in said lower plate;

a generally annular magnetic ring rigidly secured to said top plate such that said top plate is mounted with respect to said lower plate when said annular magnetic ring is magnetically engaged with said cylindrical magnets; and screen printing means for printing artwork or designs on the exposed surface of the compact disc when said printing nest is moved by said transportation means to a predetermined position.

15. The compact disc screen printing assembly of claim 14 wherein said transportation means is a rotary table.

16. The compact disc screen printing assembly of claim 14 wherein said bottom and top plates are formed of anodized aluminum.

17. The compact disc screen printing assembly of claim 14 wherein said cylindrical magnets are formed of a rare earth metal.

18. The compact disc screen printing assembly of claim 14 wherein said generally annular magnetic ring is formed of stainless steel.

19. The compact disc screen printing assembly of claim 14 wherein said generally annular magnetic ring includes an inward upwardly extending side edge fastened into an annular opening provided in a bottom surface of said top plate and an outwardly extending flange member which when said magnetic ring is fitted into a mounting opening provided in an upper surface of said bottom plate, said annular magnetic ring is magnetically engaged with said cylindrical magnets.

20. The compact disc screen printing assembly of claim 18 wherein said printing nest includes vacuum communication means provided in said upper and lower plates for reliably retaining the compact disc in said receptacle.

21. The compact disc screen printing assembly of claim 20 wherein said vacuum communication means further comprises mating vacuum communication conduits provided in both said top and lower plates which are in registration with a vacuum source.

* * * * *